United States Patent [19]

Böhme

[11] 4,083,068

[45] Apr. 11, 1978

[54] ADJUSTABLE ARTICLE OF FURNITURE

[76] Inventor: Günther Böhme, Dachswaldweg 55, 7 Stuttgart 80, Germany

[21] Appl. No.: 742,565

[22] Filed: Nov. 17, 1976

[30] Foreign Application Priority Data

Nov. 19, 1975 Germany ..... 2551819

[51] Int. Cl.[2] ..... A61G 7/10; A47C 3/32

[52] U.S. Cl. ..... 5/66; 5/68; 297/377

[58] Field of Search ..... 5/66–69, 5/164 R, 68, 69; 297/317, 322, 377

[56] References Cited

U.S. PATENT DOCUMENTS

| | | | |
|---|---|---|---|
| 825,577 | 7/1906 | Bezangu et al. | 5/66 |
| 1,356,467 | 10/1920 | Payne | 5/66 |
| 3,003,160 | 10/1961 | Goodman | 5/69 |
| 3,916,461 | 11/1975 | Kerstholt | 5/66 |
| 3,974,530 | 8/1976 | Lusch et al. | 5/66 |

FOREIGN PATENT DOCUMENTS

| | | | |
|---|---|---|---|
| 662,465 | 7/1938 | Germany | 5/66 |

*Primary Examiner*—Casmir A. Nunberg
*Attorney, Agent, or Firm*—Michael J. Striker

[57] ABSTRACT

An adjustable article of furniture, particularly an adjustable bed, has a frame and a backrest mounted on the frame for pivoting between a substantially horizontal rest position and an upright position. A leaf spring, or a plurality of such springs, is supported on the frame and urges the backrest toward its upright position. A section of the spring constitutes a seat support for the article of furniture, and can be deflected downwardly to a limited extent concurrently with pivoting of the backrest toward its upright position, from the generally straight configuration which the spring assumes when the backrest is in its rest position. The end of the spring which acts on the backrest is freely displaceable relative to the latter, either by being in sliding contact therewith, or by interposing anti-friction bearing means between the backrest and the respective end of the spring. An extension at the other end of the spring supports and biases a legrest toward a predetermined position of the same. A center portion of the spring is supported on the frame with freedom of limited displacement relative thereto to permit sagging of the seat in the upright position of the backrest. Extensions of the legrest and/or the backrest support the seat portion of the spring from underneath in the rest position of the backrest.

16 Claims, 4 Drawing Figures

ADJUSTABLE ARTICLE OF FURNITURE

BACKGROUND OF THE INVENTION

The present invention relates to an article of furniture in general, and more particularly to an adjustable article of furniture, such as an adjustable bed.

There are already known various constructions of adjustable beds and the like, among them those in which the shifting of the center of gravity of the user results in an adjustment of the position of the various components of the adjustable bed relative to one another. Such beds, while also suited for other purposes, have found their most widespread use in hospitals as hospital beds, or elsewhere for therapeutic purposes and in the care for chronically ill persons. The adjustment of the positions of the components relative to one another is attended to for supporting the patient or other user in a multitude of different positions.

The conventional beds of this type include at least a backrest which is adjustable relative to the remainder of the bed between a substantially horizontal rest position and a partly inclined or even upright position. It is also known to make the legrest a separate component of the bed, which then can be adjusted in its position relative to the seat portion of the bed. All of these conventional beds are further developments of the basic concept which is disclosed in the German Pat. No. 293,818. The backrest of the bed is pivotable on the frame of the bed about a pivoting axis which is located within the backrest, that is offset from the connection of the backrest to the remainder of the bed. A reason for this offset arrangement of the pivoting axis is that it is desired that the seat portion of the bed be inclined downwardly toward the point of its joinder with the backrest as the latter is being pivoted toward its upright position.

When the bed of the prior art is constructed in accordance with this principle of construction, it is, of necessity, relatively complex and expensive. In addition thereto, the user of the bed must exert a substantial force on the various components of the bed when the bed is to be adjusted, at least during the adjustment of the bed in one direction. This is very disadvantageous, particularly since the person who uses the bed is usually a patient who does not possess the muscular strength necessary for adjusting the position of the adjustable bed.

SUMMARY OF THE INVENTION

Accordingly, it is a general object of the present invention to overcome the above-mentioned disadvantages of the prior art.

More particularly, it is an object of the present invention to so construct an adjustable bed or the like as to be simple in construction, easy to handle, reliable and inexpensive to manufacture.

A further object of the present invention is to provide an adjustable bed in which the muscular strength of the user needed for adjusting the position of the various components of the bed relative to one another is kept to a minimum.

In pursuance of these objects and others which will become apparent hereafter, one feature of the present invention resides, in an adjustable article of furniture, particularly in an adjustable bed, briefly stated, in a combination which comprises a frame having a central plane; a backrest; means for mounting said backrest on a region of the frame for pivoting along said central plane between a substantially horizontal rest position and an upright position; and means for urging said backrest toward said upright position thereof, including at least one resiliently bendable elongated spring having one portion connected to said frame and another portion acting on said backrest in and inbetween said positions of the latter. The frame has another region which is spaced from the above-mentioned region along said central plane, and said one portion of said spring is connected to said frame at said other region of the latter, the spring including an additional portion located intermediate said one and other portion thereof, such additional portion of said spring being supported on said frame at the first-mentioned region. Under these circumstances, a section of said spring which extends between said one and said additional portion of the spring constitutes a resilient seat support intermediate said regions of said frame. Preferably, said spring is a leaf spring. Advantageously, the backrest can be arrested in any desired position thereof relative to the frame.

The above-mentioned construction of the adjustable bed is very advantageous in that only a small number of relatively simple components is necessary to manufacture and assemble the bed, such components being subjected only to a small degree of wear. Also, it provides a support which is resilient in nature during the use of the adjustable bed by the patient. Resilient means is provided not only for the backrest of the adjustable bed, but also for the seat portion thereof. In order to reduce the wear of the various components and to reduce friction therebetween, said other portion of said spring may be in a sliding contact with a portion of the backrest. As an alternative, anti-friction bearng means may be interposed between said backrest and said other portion of said spring, such bearing means including, for instance, a roller or the like. In order to enable the user to assume a proper sitting position, in which proper position the seat portion of the adjustable bed is located somewhat lower than, and rises at an angle of approximately 15° toward, the foot region of the adjustable bed, it is necessary to so construct the bed that the spring can slide downwardly to achieve the above-mentioned inclined position of the seat portion of the adjustable bed. This is achieved by supporting said additional portion of said spring on said frame on at least one support member for limited displacement relative to the frame. Thus, for instance, said additional portion of said spring may be in a sliding contact with said support member, or anti-friction means may be interposed between said support member and said additional portion of said spring. The mounting means for said backrest may include a pivot shaft which extends substantially normal to said central plane, the pivot shaft constituting said support member for said additional portion of said spring.

When the spring is displaced downwardly in the seat region of the bed, as a result of the application of a force to the seat portion of the adjustable bed, the extent of bending and, therefore, the tension of the spring is increased, and the backrest is urged towards its fully upright position as a consequence thereof.

On the other hand, it is also necessary to avoid the possibility of excessive downward displacement of the spring, upon loading of the seat portion of the adjustable bed or, in other words, it is necessary to limit the extent of the downward movement of the spring. For this purpose there is provided means for limiting the extent of movement of said additional portion of the spring relative to said frame, which includes an additional section of the spring which adjoins said additional portion of said spring and extends at an angle to the latter towards said other portion of said spring, such additional section being operative for abutting against said support member and thus for terminating the movement of said additional portion of said spring.

In a further development of the basic concept of the present invention, there is provided a legrest which is mounted on said other region of said frame for tilting relative thereto along said center plane, and said spring has an auxiliary portion which is offset from said one portion longitudinally of said spring and which acts on said legrest to urge the same toward a predetermined position. Such auxiliary portion of said spring may be an extension portion of the latter which extends beyond said other region of said frame. When the adjustable bed is constructed in this way, the position of the legrest can be automatically adjusted in dependence on the degree of the sagging of said additional section of said spring and thus in dependence on which of the upright, partially reclined or rest positions the backrest of the adjustable bed assumes.

According to a further aspect of the present invention, the backrest may include an extension which extends beyond the pivoting axis of the backrest and supports at least a part of said section of said spring from underneath in said rest position of the backrest. Instead, or in addition thereto, the legrest may include a reinforcing portion which extends beyond the tilting axis of said legrest to support at least a part of said section of said spring from underneath.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
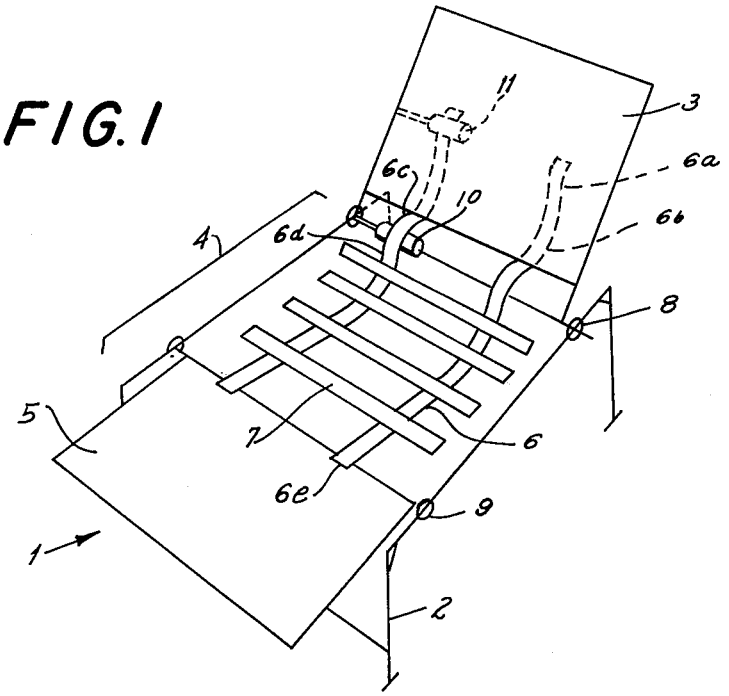
FIG. 1 is a somewhat diagrammatic perspective view of the adjustable bed according to the present invention.

Referring now to the drawing in detail, and first to FIG. 1 thereof, it may be seen that the adjustable bed of the present invention has been designated in toto with the reference numeral 1. The bed 1 includes a frame 2 of a conventional construction, a backrest 3, a seat 4 and a legrest 5. Both the backrest 3 and the legrest 5 may have plate-shaped configurations. A spring 6, such as a leaf spring, extends between and is connected to the backrest 3 and to the legrest 5. Support plates 7 are connected to the spring 6 to form the seat 4 of the adjustable bed 1. As illustrated, two springs 6 are provided, and the support plates 7 extend between and beyond the two springs 6. Of course, there can be provided only one or more than two springs 6; also, the support plates 7 could be omitted. A non-illustrated conventional mattress may be supported on the backrest 3, the seat 4 and the legrest 5.

The backrest 3 is mounted on the frame 2 for pivoting about a pivot axis 8, and the legrest 5 is supported on the frame 2 for tilting relative thereto between various positions about a tilting axis 9. The axes 8 and 9 are parallel to each other and are spaced from one another in direction of a central plane of the adjustable bed 1.

Figure 2:
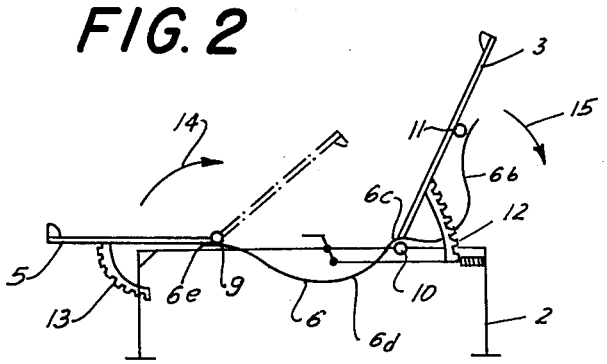
FIG. 2 is a side view of FIG. 1 in an upright position of the backrest.
Figure 3:
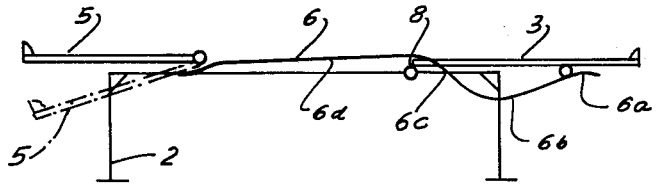
FIG. 3 is a view similar to FIG. 2 but in the rest position of the backrest.

As particularly illustrated in FIGS. 2 and 3, the adjustable bed 1 is adjustable between a position illustrated in FIG. 2 in which the backrest 3 assumes a substantially vertical upright position and the position illustrated in FIG. 3 in which the backrest 3 is in its substantially horizontal rest position.

The spring 6 has one portion 6*a* which acts on the backrest 3 to urge the same towards its upright position, another portion 6*b* which urges the portion 6*a* toward the backrest 3, sections 6*c* and 6*d* which enclose an angle with one another in the region of the pivot axis 8, and a portion 6*e* which acts on the legrest 5. The spring 6 is trained about the pivot axis 8 and is either in sliding contact therewith, or a roller 10 is mounted on the pivot axis 8 and is in rolling contact with the section 6*d* of the spring 6. Both of these possibilities are illustrated in FIG. 1 in connection with the left-hand and right-hand springs 6. The portion 6*a* of the spring 6 is either in a direct sliding contact with the backrest 3, or a roller 11 or the like anti-friction means is interposed between the portion 6*a* of the spring 6 and the backrest 3, and is in a rolling contact with one of the two. Also these two possibilities are illustrated in FIG. 1.

As illustrated in FIG. 2, conventional arresting arrangements 12 and 13 may be provided between the frame 2 and the backrest 3, on the one hand, and between the frame 2 and the legrest 5, on the other hand. Inasmuch as these arresting arrangements are completely conventional, no discussion thereof is necessary.

The portion 6*e* of the spring 6 can either be attached to the legrest 5 but, in a currently preferred embodiment of the present invention, it only contacts a portion of the legrest 5 and urges the same upwardly, so that the legrest 5 can be dissociated from the portion 6*e* of the spring 6 and tilted about its tilting axis 9 in the direction of an arrow 14 (FIG. 2) to eventually rest on the seat 4, whereby the adjustable bed is partially folded either for storage purposes, or for use as a chair having an adjustable backrest. The area of contact of the portion 6*e* of the spring 6 is somewhat offset from the tilting axis 9 of the legrest 5 so that, as the backrest 3 moves between its upright and rest positions, the portion 6*e* of the spring 6 will change its spatial position in dependence on the shape assumed where by the section 6*d*. As illustrated in FIGS. 2 and 3, the basic position which the legrest 5 assumes is illustrated in full lines, and it is that position which the legrest 5 assumes when the backrest 3 is in its upright position. When the backrest 3 is in its rest position, on the other hand, the portion 6*e* of the spring 6 will exert a much lower force on the legrest 5 so that the latter will tend to assume the position illustrated in broken lines in FIG. 3. However, it is to be understood that the illustrated positions of the legrest 5 are illustrative only and do not necessarily indicate the position of the legrest 5 during the actual use of the bed 1. So, for instance, the spring 6 could so act on the legrest 5 that the latter would assume its horizontal position in the rest position of the backrest 3, while the legrest 5 could assume a position in which it would form a continuation of the curve of the section 6*d* of the spring 6 in the upright position of the backrest 3. As already mentioned above, the sections 6c and 6d of the spring 6, which are trained about the pivot axis 8, enclose an angle with one another. When the backrest 3 is moved, in direction opposite to the arrow 15, from its position illustrated in FIG. 3 into its position illustrated in FIG. 2, the section 6d of the spring 6 will be displaced relative to the pivot axis 8 in the leftward direction as seen in the drawing, until the section 6c of the spring 6 abuts against the pivot axis 8 and thus terminates the further displacement of the spring 6 relative to the pivot axis 8. When this happens, the backrest 3 is in its upright position, and the section 6d of the spring 6 bulges downwardly in the region of the seat 4. It will be seen that, in the position illustrated in FIG. 2, smooth transition is provided between the backrest 3 and the section 6d of the spring 6, and that the section 6d gradually rises toward the legrest 5 so that the user of the bed 1 will automatically assume the proper sitting position in the bed 1, being properly supported by the backrest 3, the support plates 7 and the legrest 5 and the mattress which is interposed between the body of the user and the bed 1.

Having so discussed the construction of the bed 1 of the present invention, the operation of the bed will now be briefly discussed. Starting, for instance, with the position of the bed 1 illustrated in FIG. 3, and assuming that the arresting arrangements 12 and 13 arrest the backrest 3 and the legrest 5 in their respective positions, the user of the bed 1 will be able to assume a lying position on the bed 1. Of course, the user can also assume a sitting position on the bed 1 without changing the relative positions of the backrest 3 and legrest 5, inasmuch as the arresting arrangements 12 and 13 are engaged and prevent any displacement of either the backrest 3 or the legrest 5.

When it is desired to erect the backrest 3, at least the arresting arrangement 12 is to be disengaged. Once this happens, the backrest 3 is free to pivot about the pivot axis 8. Now, so long as the user of the bed 1 maintains his lying position, the bed 1 stays in its position illustrated in FIG. 3, On the other hand, once the user starts raising the upper portion of his body, his weight will predominantly rest on the seat portion 4, whereby the spring 6 will be changed in shape in the region of its section 6d from the straight configuration of FIG. 3 toward the curved configuration of FIG. 2. Simultaneously therewith, the section 6d will be displaced relative to the pivot axis 8, in the leftward direction as seen in the drawings, until eventually the section 6c of the spring 6 abuts against pivot axis 8. Simultaneously with the bending of the section 6d, the section 6c and the portion 6b of the spring 6 will change spatial positions and thus lift the backrest 3 towards its upright position. Inasmuch as the body weight of the user has been transferred, predominantly or fully, to the seat 4, no or only an insubstantial force will act on the backrest 3 contrary to the action of the portion 6a on the backrest 3. It will be appreciated that when the entire body weight is transferred to the seat portion, the backrest 3 will not terminate its pivoting until it reaches the position illustrated in FIG. 2. On the other hand, if the body weight is only partially transferred, then equilibrium of the forces acting on the backrest 3 can be achieved anywhere intermediate the rest position and the upright position of the backrest 3. Upon engagement of the arresting arrangement 12, the backrest 3 will be arrested in any selected position thereof.

Figure 4:
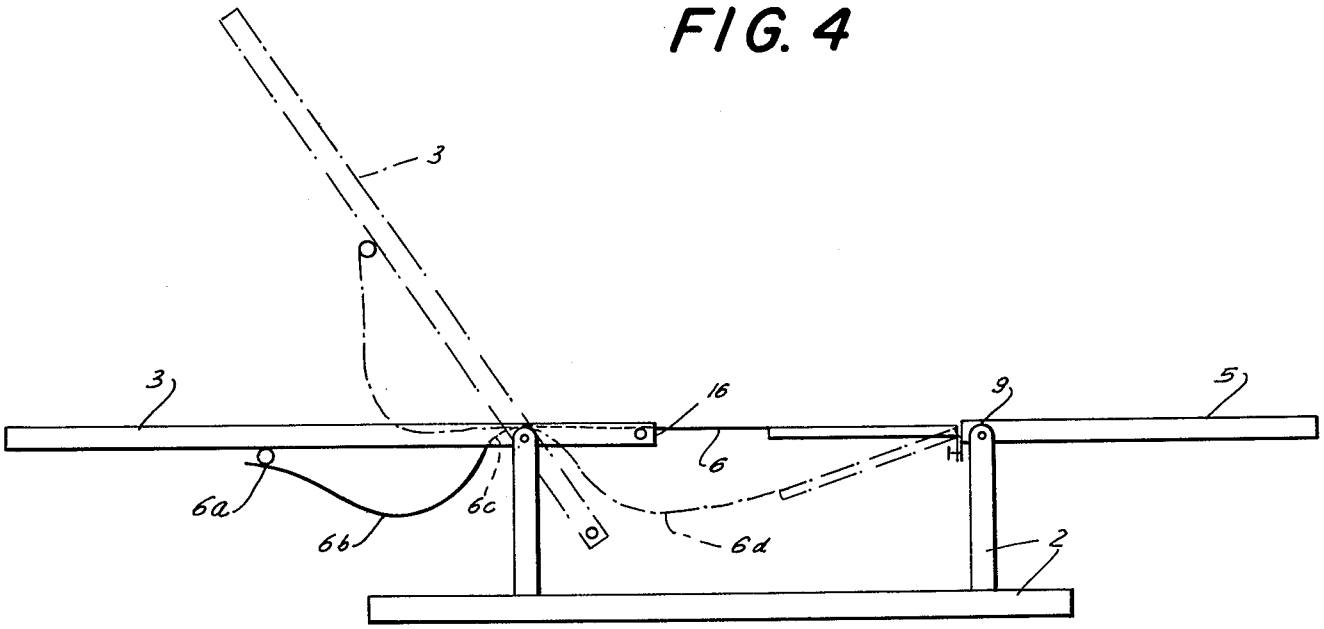
FIG. 4 is a view similar to FIG. 3 but illustrating additional features of the present invention.

The adjustment of the position of the legrest 5 occurs in a similar manner. The portion 6e of the spring 6 biases the legrest 5 in the upward direction toward a position of equilibrium, with a somewhat smaller force in the position of FIG. 3 than that present in the position of FIG. 2. So long as the arresting arrangement 13 arrests the legrest in its respective position, only the magnitude of the force with which the portion 6e acts on the legrest will change, but not the position of the legrest 5. On the other hand, once the arresting arrangement 13 is released, the legrest 5 will be free to assume its position of equilibrium which will be determined by the instantaneous force with which the portion 6e of the spring 6 acts on the legrest 5 which, in turn, depends on the degree of the downward bending of the section 6d of the spring 6. Of course, the position of equilibrium will also depend on any external forces which will act on the legrest 5 in the same direction as, or in a direction opposite to, the action of the portion 6e of the spring 6 on the legrest 5. Here again, the arresting arrangement 13 can arrest the legrest 5 in any selected position thereof. Coming now to the modification which is illustrated in FIG. 4, it is to be mentioned that most of the parts of the bed 1 of this modified embodiment are identical with those illustrated and described above in connection with FIGS. 1–3 so that the same reference numerals have been assigned to such identical or corresponding parts. In addition to such common parts, FIG. 4 also illustrates that the backrest 3, which is illustrated in its two end positions, may have an extension 16 which extends beyond the pivot axis 8 on which the backrest 3 is mounted for pivoting. In the rest position of the backrest 3 which is illustrated in full lines in FIG. 4, the extension 16 supports the section 6d of the spring 6 from underneath and thus prevents undue sagging of the section 6d in such rest position.

In addition to, or instead of, the extension 16, there may be provided a reinforcing portion 17 at the legrest 5, which reinforcing portion 17 extends beyond the tilting axis 9 of the legrest 5 and supports the section 6d of the spring 6 from underneath, at least when the legrest 5 assumes its illustrated horizontal position.

The extension 16 can be of one piece with, or a separate part rigidly connected to, the backrest 3. On the other hand, the reinforcement 17 may either be of one piece with or rigidly connected to the legrest 5, or it can only be connected to the spring 6 in a left-hand zone of the section 6d thereof, thus reinforcing such zone.

It will be understood that each of the elements described above, or two or more together, may also find a useful application in other types of constructions differing from the types described above.

While the invention has been illustrated and described as embodied in an adjustable bed, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an adjustable article of furniture, particularly adjustable bed, a combination comprising a frame having a central plane and a first and a second region spaced from one another along said central plane; a backrest; means for mounting said backrest on said first region of said frame for pivoting along said central plane between a substantially horizontal rest position and an upright position; and means for urging said backrest toward said upright position thereof, including at least one resiliently bendable elongated spring having one portion connected to said frame at said second region of the latter, another portion acting on said backrest in and inbetween said positions of the latter, and an additional portion located intermediate said one and other portions of said spring and supported on said frame at said first region.

2. A combination as defined in claim 1, wherein said spring is a leaf spring.

3. A combination as defined in claim 1, wherein said other portion of said spring is in sliding contact with a portion of said backrest.

4. A combination as defined in claim 1; and further comprising anti-friction bearing means interposed between said backrest and said other portion of said spring.

5. A combination as defined in claim 4, wherein said bearing means includes at least one roller.

6. A combination as defined in claim 1, wherein a section of said spring which extends between said one and said additional portions of said spring constitutes a resilient seat support intermediate said regions of said frame.

7. A combination as defined in claim 6; and further comprising means for supporting said additional portion of said spring on said frame for limited displacement relative thereto, including at least one support member.

8. A combination as defined in claim 7, wherein said additional portion of said spring is in sliding contact with said support member.

9. A combination as defined in claim 7, wherein said supporting means further includes anti-friction bearing means interposed between said support member and said additional portion of said spring.

10. A combination as defined in claim 7, wherein said mounting means for said backrest includes a pivot shaft extending substantially normal to said central plane; and wherein said pivot shaft constitutes said support member for said additional portion of said spring.

11. A combination as defined in claim 7, wherein said supporting means further includes means for limiting the extent of movement of said additional portion of said spring relative to said frame.

12. A combination as defined in claim 11, wherein said limiting means includes an additional section of said spring which adjoins said additional portion of said spring and extends at an angle to the latter toward said other portion of said spring, and operative for abutting against said support member and thus terminating the movement of said additional portion of said spring.

13. A combination as defined in claim 7; further comprising a legrest mounted on said other region of said frame for tilting relative thereto along said central plane; and wherein said spring has an auxiliary portion which is offset from said one portion longitudinally of said spring and which acts on said legrest to urge the same toward a predetermined position.

14. A combination as defined in claim 13, wherein said auxiliary portion is an extension portion of said spring which extends beyond said other region of said frame.

15. A combination as defined in claim 13, wherein said legrest includes a reinforcing portion which extends beyond the tilting axis of said legrest to support at least a part of said section of said spring from underneath.

16. A combination as defined in claim 7, wherein said backrest includes an extension which extends beyond the pivoting axis of said backrest and supports at least a part of said section of said spring from underneath in said rest position of said backrest.

* * * * *